US005280253A

United States Patent [19]

Deki et al.

[11] Patent Number: 5,280,253

[45] Date of Patent: Jan. 18, 1994

[54] CYLINDRICAL WAVEGUIDE-TO-MICROSTRIP LINE CONVERTER

[75] Inventors: Akihito Deki, Amagasaki; Yukiro Kashima, Takatsuki; Kazuyoshi Nishioka, Amagasaki; Shozo Aono, Takatsuki; Akira Kinoshita, Osaka; Yasufumi Siomi, Fujisawa, all of Japan

[73] Assignee: Matsushita Electric Industrial Co. Ltd., Osaka, Japan

[21] Appl. No.: 849,070

[22] PCT Filed: Aug. 30, 1991

[86] PCT No.: PCT/JP91/01157

§ 371 Date: Apr. 23, 1992

§ 102(e) Date: Apr. 23, 1992

[87] PCT Pub. No.: WO92/04744

PCT Pub. Date: Mar. 19, 1992

[30] Foreign Application Priority Data

Aug. 31, 1990 [JP] Japan ..... 2-231706

[51] Int. Cl.[5] ..... H01P 5/107

[52] U.S. Cl. ..... 333/26; 333/246

[58] Field of Search ..... 333/26, 33, 243, 245, 333/246

[56] References Cited

U.S. PATENT DOCUMENTS

| | | | |
|---|---|---|---|
| 4,837,529 | 6/1989 | Gawronski et al. | 333/33 |
| 4,868,639 | 9/1989 | Mugiya et al. | 333/26 X |

FOREIGN PATENT DOCUMENTS

| | | | |
|---|---|---|---|
| 0500949A1 | 9/1992 | European Pat. Off. . | |
| 101 | 1/1985 | Japan | 333/33 |
| 61-189601 | 11/1986 | Japan . | |
| 63-260301A | 10/1988 | Japan . | |
| 2-183601 | 7/1990 | Japan . | |

*Primary Examiner*—Paul Gensler

*Attorney, Agent, or Firm*—Stevens, Davis, Miller & Mosher

[57] ABSTRACT

A microwave circuit includes a concentric-circle-like prominence (7) formed on a contact surface which is on the side of a metal body (3) serving as an external conductor of a coaxial line and which connects a conductor strip (1) of an MSL formed on a dielectric substrate (2) to an internal conductor of the coaxial line through a through-hole (9) extending from a ground plane (11) of the MSL through the dielectric substrate (2). The construction involves no mismatched portion and can prevent a loss and deterioration in VSWR in the coaxial-line/MSL conversion section, thereby making it possible to obtain satisfactory characteristics.

2 Claims, 4 Drawing Sheets

CYLINDRICAL WAVEGUIDE-TO-MICROSTRIP LINE CONVERTER

TECHNICAL FIELD

The present invention relates to a microwave circuit used in a microwave communication apparatus, a satellite broadcast receiving converter or the like.

BACKGROUND ART

Recently, there have been remarkable developments in microwave devices used in microwave communication apparatuses, and it is easy to procure low-noise devices such as HEMT and MES-FET, so that the noise factor in reception-type low-noise converters, in particular, is decreasing year after year. However, even if the low-noise microwave device itself exhibits a satisfactory noise factor, the loss and impedance mismatching between the input section and the microwave device have a significant influence, making it impossible, in some cases, to obtain a desired noise factor for the low-noise converter as a whole.

Such a conventional microwave circuit will be described with reference to the drawings.

FIG. 5 shows a short-circuit section of a conventional cylindrical-waveguide (hereinafter referred to simply as "CWG") - microstrip line (hereinafter referred to simply as "MSL") conversion section; FIG. 6 is a sectional view of the same; FIG. 7 is an enlarged view of a dielectric substrate forming an MSL; and FIG. 8 is a reverse-side view of the same.

In FIGS. 5 to 8, numeral 1 indicates a conductor strip of the MSL; numeral 2 indicates a dielectric substrate; numeral 3 indicates a metal body having a CWG 4; numeral 5 indicates a post; numeral 6 indicates a Teflon supporter; numeral 9 indicates a through-hole for connecting the conductor strip 1 with the post 5; and numeral 11 indicates a ground plane of the dielectric substrate 2.

The operation of the microwave circuit, constructed as described above, will be explained. First, in FIGS. 5 and 6, a microwave propagated through the CWG 4 is converted to a coaxial-line mode in the section of the post 5, and propagated through the coaxial line using the Teflon supporter 6 as an internal dielectric. Next, in FIGS. 7 and 8, the microwave propagated through the coaxial line is mode-converted by a matching pattern 10 provided in the ground plane 11 of the dielectric substrate 2 to an MSL having the same characteristic impedance as the coaxial line without involving any deterioration in characteristics. Then, the post 5, which constitutes the central conductor of the coaxial line, is connected to the conductor strip 1 through the through-hole 9.

In the above-described construction, however, a sufficient contact may not be attained between the portion of the ground plane around the matching pattern 10 of the dielectric substrate 2 and the metal body 3 due to any warp of the dielectric substrate 2 or an inadequate flatness of the metal body 3. In such a case, the characteristic impedance of the coaxial line differs from that of the MSL, and mismatching is caused, resulting in a passing loss and deterioration in VSWR.

In view of the above problem, it is an object of the present invention to provide a microwave circuit in which the external conductor of the coaxial line is held in an adequate contact with the ground plane of the MSL, thereby preventing a passing loss and deterioration in VSWR in the coaxial-line/MSL conversion section.

DISCLOSURE OF THE INVENTION

To achieve the above object, the microwave circuit of the present invention comprises a concentric-circle-like prominence formed on a contact surface which is on the side of a metal body serving as an external conductor of a coaxial line and which connects a conductor strip of an MSL formed on a dielectric substrate to an internal conductor of the coaxial line through a through-hole extending from a ground plane of the MSL through the dielectric substrate.

Due to the above construction of the present invention, the coaxial-line-external-conductor section on the side of the metal body is positively held in contact with the ground plane of the MSL by virtue of the concentric-circle-like prominence, so that no mismatching is involved and it is possible to prevent any loss and deterioration in VSWR in the coaxial-line/MSL conversion section, thereby ensuring satisfactory characteristics.

BEST MODE FOR CARRYING OUT THE INVENTION

Figure 1:
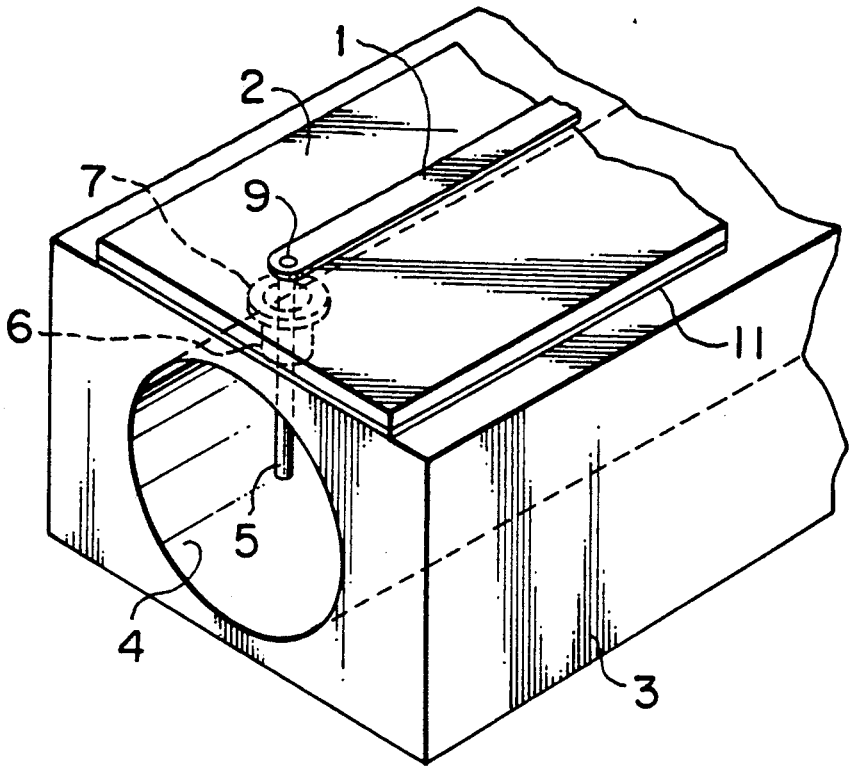
FIG. 1 is a perspective view of a CWG/MSL conversion section in an embodiment of the present invention.
Figure 2:
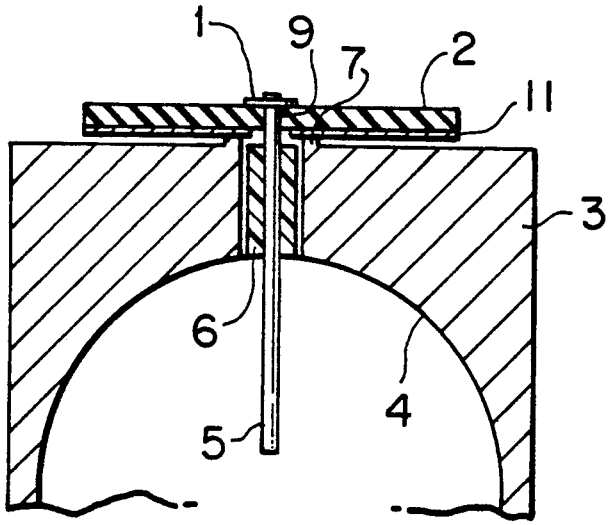
FIG. 2 is a sectional view of the same.

An embodiment of the present invention will now be described with reference to the drawings. FIG. 1 is a perspective view of a CWG/MSL conversion section in an embodiment of the present invention, and FIG. 2 is a sectional view of the same. In FIGS. 1 and 2, numeral 1 indicates a conductor strip of an MSL; numeral 2 indicates a dielectric substrate; numeral 3 indicates a metal body including a CWG 4; numeral 5 indicates a post; numeral 6 indicates a Teflon supporter; numeral 7 indicates a concentric-circle-like prominence; numeral 9 indicates a through-hole for connecting the conductor strip 1 with the post 5; and numeral 11 indicates a ground plane of the dielectric substrate 2.

The operation of the microwave circuit, constructed as described above, will now be explained. First, a microwave being propagated through the CWG 4 is converted into a coaxial-line mode through the section of the post 5, and then propagated to a coaxial line using the Teflon supporter 6 as an internal dielectric. Then, the microwave propagated through the coaxial line is converted by a matching pattern provided in the ground plane 11 of the dielectric substrate 2 into an MSL having the same characteristic impedance as the coaxial line, without involving any deterioration in VSWR. The section of the post 5 which has been passed through the through-hole is connected with the conductor strip 1.

In this embodiment, by virtue of the concentric-circle-like prominence 7, an adequate contact can be attained between the external conductor of the coaxial line and the ground plane of the above MSL without being affected by any warp of the dielectric substrate 2 or the like, so that a perfect ground-plane matching can be realized, with no mismatched section being generated. Thus, in accordance with this embodiment, it is possible to realize a satisfactory coaxial-line/MSL conversion section involving no passing loss or deterioration in VSWR, by virtue of the concentric-circle-like prominence 7.

Next, another embodiment of the present invention will be described with reference to the drawings.

Figure 3:
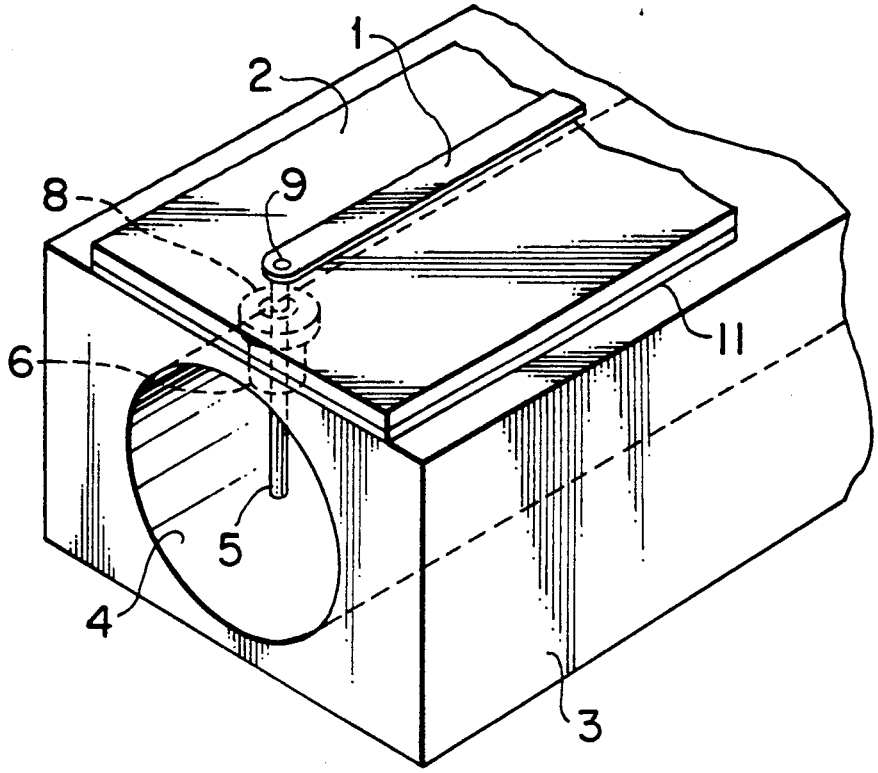
FIG. 3 is a perspective view of a CWG/MSL conversion section in another embodiment of the present invention.
Figure 4:
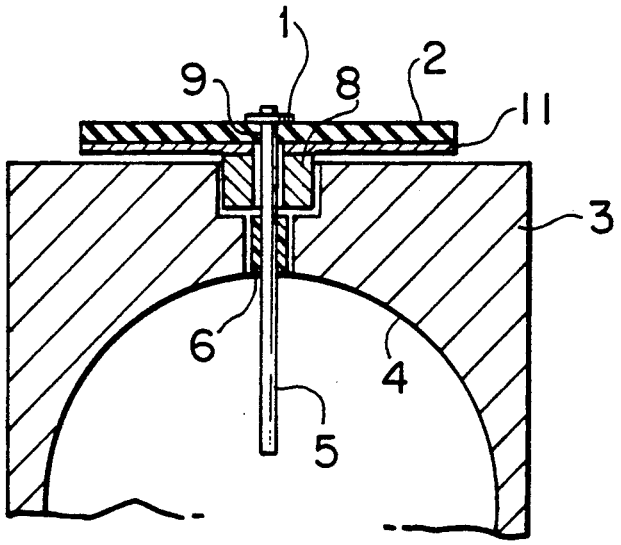
FIG. 4 is a sectional view of the same.
Figure 5:
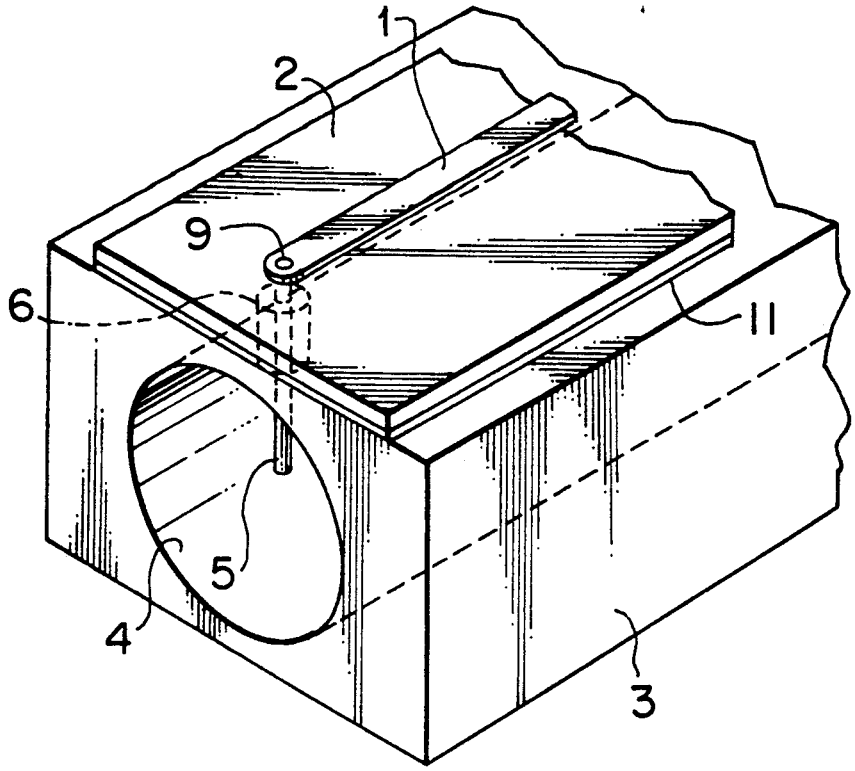
FIG. 5 PRIOR ART
FIG. 5 is a perspective view of a conventional CWG/MSL conversion section.
Figure 6:
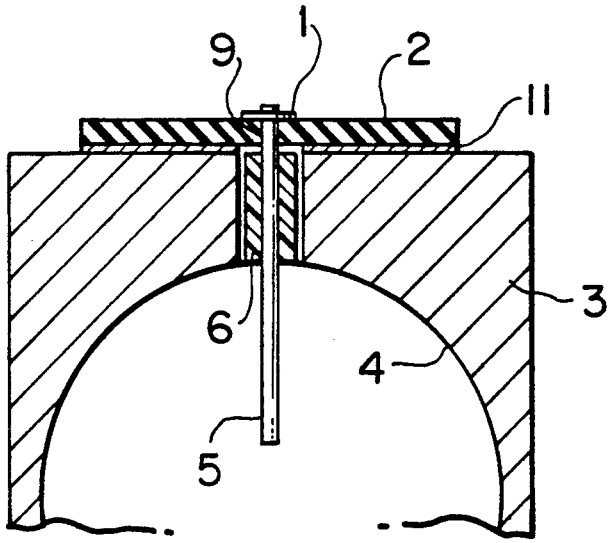
FIG. 6 PRIOR ART
FIG. 6 is a sectional view of the same.
Figure 7:
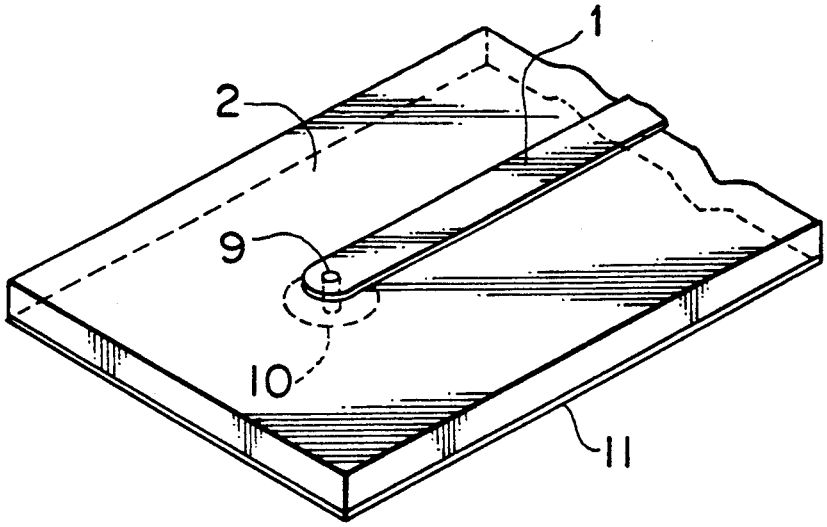
FIGS. 7 and 8 are an enlarged view and a reverse-side view of a dielectric substrate forming an MSL.
Figure 8:
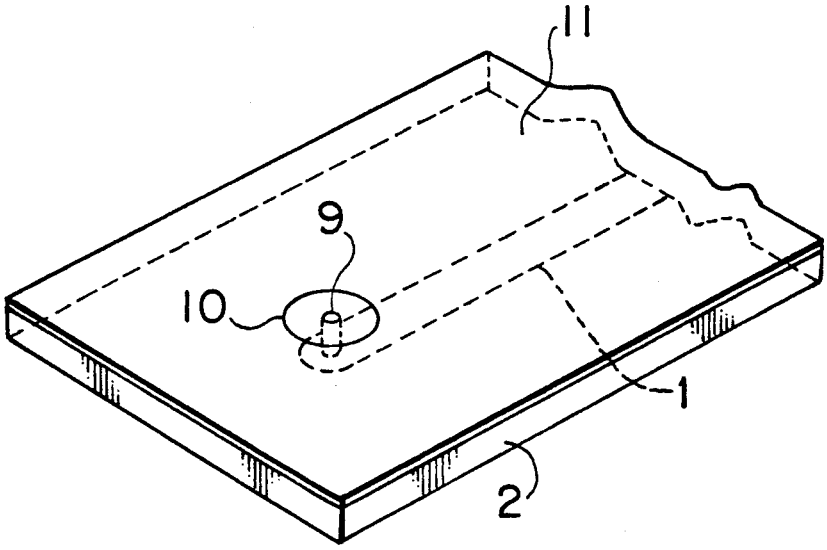

FIG. 3 is a perspective view of a CWG/MSL conversion section in another embodiment of the present invention, and FIG. 4 is a sectional view of the same. In FIGS. 3 and 4, numeral 1 indicates a conductor strip of an MSL; numeral 2 indicates a dielectric substrate; numeral 3 indicates a metal body including a CWG 4; numeral 5 indicates a post; numeral 6 indicates a Teflon supporter; numeral 8 indicates a metal supporter; numeral 9 indicates a through-hole for connecting the conductor strip 1 with the post 5; and numeral 11 indicates a ground plane of the dielectric substrate 2.

The operation of the microwave circuit, constructed as described above, will now be explained. First, a microwave being propagated through the CWG 4 is mode-converted in the section of the post 5 into a coaxial line using the Teflon supporter 6 as an internal dielectric, and then into a hollow coaxial line using the interior of the metal supporter 8 as an external conductor. Then, it is converted into an MSL having the same characteristic impedance as that of the two types of coaxial lines mentioned above. The section of the post 5 which has been passed through the through-hole is connected with the conductor strip 1.

In this embodiment, the metal supporter 8 is made somewhat higher than the metal body 3, whereby it is possible to attain an adequate contact between the external conductor of the coaxial line and the ground plane of the MSL, thereby realizing a perfect ground-plane matching and preventing the generation of a mismatched portion with no influence by a warp of the dielectric substrate 2. Thus, in accordance with this embodiment, an appropriate height of the metal supporter 8 is selected, thereby realizing a satisfactory coaxial-line/MSL conversion section involving no passing loss or deterioration in VSWR.

INDUSTRIAL APPLICABILITY

Thus, in accordance with the present invention, the concentric-circle-like prominence is provided on a contact surface which is on the side of the metal body serving as an external conductor of a coaxial line and which connects the conductor strip of the MSL formed on the dielectric substrate to an internal conductor of the coaxial line through the through-hole extending from the ground plane of the MSL through the dielectric substrate, whereby it is possible to realize a satisfactory coaxial-line/MSL conversion section involving no passing loss or deterioration in VSWR, thus providing a remarkable advantage in terms of utility.

What is claimed is:

1. A microwave circuit comprising:

a metal body defining therein a cylindrical waveguide and having a contact surface and a bore extending from said cylindrical waveguide to said contact surface, said bore having a small diameter bore part extending from said cylindrical waveguide to an intermediate position of said bore and a large diameter bore part extending from said intermediate position to said contact surface, said metal body serving as an external conductor of a coaxial line;

a dielectric substrate laid on said metal body and having a ground plane of a microstrip line in contact with said contact surface of said metal body, and a first through-hole piercing through said dielectric substrate;

a conductor strip of said microstrip line laid on said dielectric substrate on a surface opposite to said ground plane and having a second through-hole piercing through said conductor strip;

a hollow dielectric supporter fitted within said small diameter bore part;

a hollow metal supporter fitted in said large diameter bore part and projecting from said contact surface so as to make positive contact with said ground plane of said dielectric substrate; and a conductor which serves as an internal conductor of the coaxial line, which is connected to said conductor strip, which extends through said second through-hole formed in said conductor strip, said first through-hole formed in said dielectric substrate, said hollow metal supporter and said hollow dielectric supporter, and which projects into said cylindrical waveguide;

whereby an adequate contact is made between said metal body and said ground plane of said microstrip line.

2. A microwave circuit as in claim 1, wherein said conductor serving as said internal conductor is a post.

* * * * *